US005375101A

United States Patent [19]

Wolfe et al.

[11] Patent Number: 5,375,101

[45] Date of Patent: Dec. 20, 1994

[54] ELECTROMAGNETIC SONAR TRANSMITTER APPARATUS AND METHOD UTILIZING OFFSET FREQUENCY DRIVE

[75] Inventors: William R. Wolfe, Penn Hills; Thomas Kupiszewski, Harrison City, both of Pa.

[73] Assignee: Westinghouse Electric Corporation, Pittsburgh, Pa.

[21] Appl. No.: 79,116

[22] Filed: Jun. 17, 1993

Related U.S. Application Data

[63] Continuation-in-part of Ser. No. 933,272, Aug. 21, 1992, abandoned.

[51] Int. Cl.[5] ..... H04R 9/00

[52] U.S. Cl. ..... 367/175; 367/142; 181/110

[58] Field of Search ..... 367/137, 903, 141, 142, 367/175; 310/317; 181/110

[56] References Cited

U.S. PATENT DOCUMENTS

| | | | |
|---|---|---|---|
| 3,974,476 | 8/1976 | Cowles | 340/18 R |
| 4,296,486 | 10/1981 | Vasile | 367/140 |
| 4,400,804 | 8/1983 | Konrad | 367/137 |
| 4,868,799 | 9/1989 | Massa | 367/172 |
| 5,047,997 | 9/1991 | Forsberg | 367/191 |
| 5,062,089 | 10/1991 | Willard et al. | 367/172 |
| 5,126,979 | 6/1992 | Rowe, Jr. et al. | 367/175 |

OTHER PUBLICATIONS

Robert J. Urick, *Principles of Underwater Sound* 83–86 (3d ed. 1983).

*Proceedings of the Workshop on Low Frequency Sound Sources*, 5–7 Nov. 1973, vol. 1, pp. 129, 173–178, 183, 205–206, (Office of Naval Research, Report No. NUC TP 404).

*Primary Examiner*—J. Woodrow Eldred

[57] ABSTRACT

A sonar transmitter includes a source means for providing an actuation signal to drive an electromagnetic transducer projector without the use of bias magnetization. The invention utilizes an offset actuation frequency technique in which electrical driving signals are applied which have a frequency or frequencies other than the desired frequency of the acoustic signal projected into a liquid medium. In presently preferred embodiments, one or two driving signals may be utilized. If one driving signal is utilized, the acoustic signal will be at twice the driving signal frequency. If two driving signals are utilized, the acoustic signal will be at the sum or difference frequency of the driving signal frequency. The actuation signal is applied to coils of the transducer's electromagnets to produce an electromagnetic attractive force having a significant component at the desired frequency of the acoustic signal. The force component urges movement of the electromagnets, causing a radiating surface of the transducer to elastically flex, thereby producing the acoustic signal.

34 Claims, 5 Drawing Sheets

ELECTROMAGNETIC SONAR TRANSMITTER APPARATUS AND METHOD UTILIZING OFFSET FREQUENCY DRIVE

CROSS REFERENCE TO A RELATED APPLICATION

This is a continuation-in-part of application Ser. No. 07/933,272, filed Aug. 21, 1992 now abandoned.

BACKGROUND OF THE INVENTION

1. Field of the Invention

This invention relates generally to electromagnetic sonar transmitters. More particularly, the invention relates to an electromagnetic sonar transmitter apparatus and method which eliminates the prior art requirement for bias magnetization by utilizing driving signals having frequencies offset from the frequency of the radiated acoustic signal.

2. Description of the Prior Art

Sonar systems detect and characterize objects in a liquid medium by first impressing an acoustic signal into the medium and subsequently analyzing the returning echo. In order to provide the necessary acoustic signal, various transmitters have been developed. Typically, these transmitters include a signal source operating a submerged acoustic projector comprising some type of signal transducer.

One type of acoustic projector transducer well-known in the prior art is the piezoelectric transducer. These transducers utilize piezoelectric elements which deform upon the application of a voltage to produce an acoustic signal. Piezoelectric transducers, however, have been found to have significant drawbacks. For example, they become massive and complex at low frequencies. Further, piezoelectric transducers are susceptible to performance variations depending on depth.

Another type of projector transducer, which has been found, for example, to be more suitable for operation at lower frequencies than the piezoelectric transducer is the electromagnetic transducer. Electromagnetic transducers are typically constructed having at least one movable electromagnet affixed to a radiating surface. A driving signal applied to the electromagnet produces a magnetic attraction force urging displacement of the radiating surface. This magnetic attraction force has generally been derived by prebiasing the electromagnets and driving them at the desired frequency with a controlled voltage or current source. Bias magnetization, which may be provided by DC electromagnets or, equivalently, permanent bias magnets (or both), was believed necessary in order to make operation of the electromagnetic transducer linear.

The use of bias magnetization in electromagnetic transducers introduces a number of undesirable characteristics. For example, requirements for linearized operation with low harmonic distortion severely limit the amount of magnetic field fluctuation about the prebias field level. This is due to the fact that large excursions of the electromagnet may cause its respective pole faces to pull and stick together. Furthermore, the use of a permanent magnet for prebias may enhance sensitivity to operating depth because increases in external hydrostatic pressure causes structural compliance of the projector. This, in turn, decreases the separation between the pole faces of the electromagnets which can result in sticking, as described above.

SUMMARY OF THE INVENTION

Sonar transmitters practicing the present invention include a source means for providing an actuation signal to an electromagnetic transducer projector. The projector includes a radiating surface from which an acoustic signal is radiated into a liquid medium when the actuation signal is applied. The actuation signal is the result of at least one driving signal having a fundamental frequency at a frequency other than the preselected frequency of the acoustic signal. The offset frequency drive arrangement of the invention generally eliminates the need to operate the electromagnetic transducer projector with bias magnetization as has been required in the past. In addition to obviating drawbacks of the prior art, the present invention is believed to operate more efficiently within an overall projector structure smaller than has previously been necessary.

The actuation signal may comprise one or two driving signals depending on the exigencies of the particular application. For example, if a relatively high frequency acoustic signal is desired, a driving signal may be used which is one-half the frequency of the desired acoustic signal. Also, a pair of lower frequency driving signals may be used to produce a higher frequency acoustic signal equal to the sum frequency of the driving signals. If a low frequency acoustic signal is desired, a pair of driving signals may be used which have a frequency difference equal to the desired frequency of the radiated acoustic signal.

In presently preferred embodiments, the transducer comprises an elliptical Class IV flextension shell member having a pair of opposed and substantially identical electromagnets. The opposed electromagnets may be directed along either the major axis or minor axis of the shell member. Opposing pole faces of cores of the electromagnets are separated by a spatial gap.

The actuation signal produced by the source means is applied to coils of the electromagnets. As a result, an electromagnetic attractive force is produced having a significant component at the desired frequency of the acoustic signal. This force component urges the opposing pole faces together, causing the shell member to elastically flex. The resulting change in shell volume generates a volume velocity fluctuation, which in turn produces the acoustic signal.

DETAILED DESCRIPTION OF PRESENTLY PREFERRED EMBODIMENTS

In accordance with the present invention, a sonar transmitter may be provided using an electromagnetic transducer projector producing an acoustic signal without bias magnetization. For the same desired fundamental output force, the invention generally achieves a wider bandwidth with less harmonic distortion and lower overall size and weight than the prior art.

Although the teachings of the present invention can be used to retrofit existing electromagnetic sonar transducers, presently preferred new embodiments utilize transducers having a Class IV flextension shell. As disclosed in U.S. Pat. No. 5,126,979, issued Jun. 30, 1992 to Rowe, Jr. et al. and incorporated herein by reference, these transducers offer the advantages of depth invariant performance and relatively few moving parts. Additionally, these transducers are versatile since they can be alternatively driven along either of two mutually orthogonal axes.

Figure 1B:
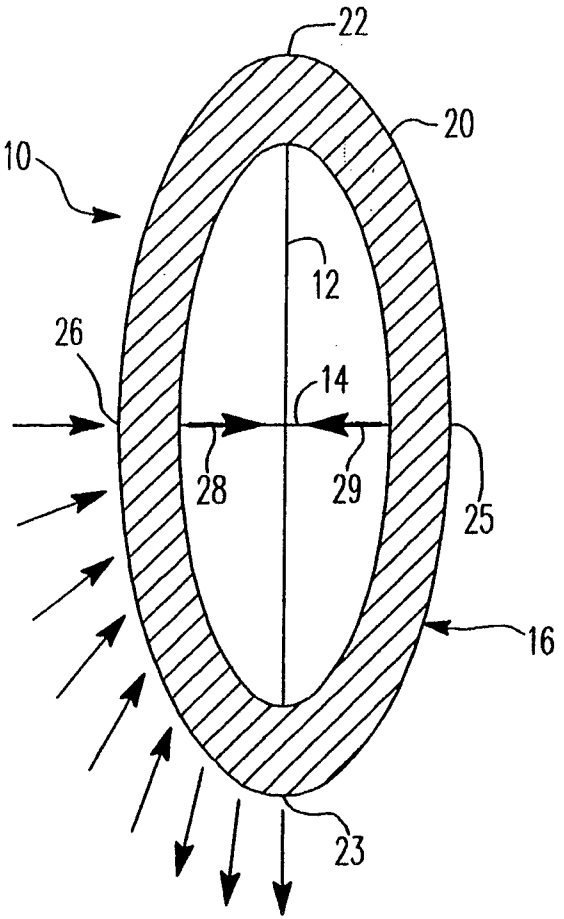
FIGS. 1A and 1B are diagrammatic views illustrating actuation along the major and minor axes, respectively, of a Class IV flextension shell of the type which may be used with the present invention.
Figure 1A:
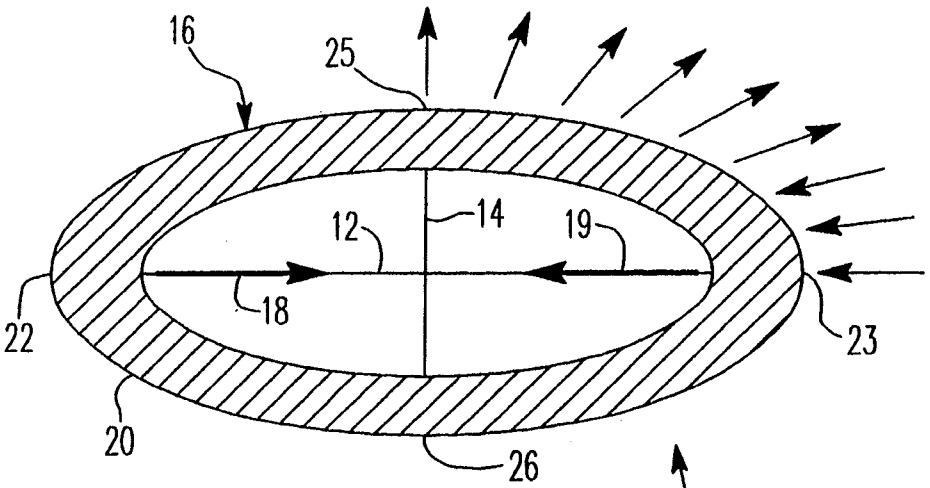

Referring to FIGS. 1A and 1B, a Class IV flextension shell 10 is illustrated being respectively driven along major axis 12 and minor axis 14. Electromagnet means directed along either of these axes produce magnetic attractive forces which cause elliptical body member 16 to flex in a quadrupole volumetric mode.

Referring specifically to FIG. 1A, oppositely directed attractive forces 18 and 19 flex radiating surface 20 inward at extremity regions 22 and 23, which are adjacent respective termini of axis 12. This causes radiating surface 20 to flex outwardly at inner regions 25 and 26 as illustrated by the arrows. Alternatively, as shown in FIG. 1B, oppositely directed forces 28 and 29 cause inward deflection at regions 25 and 26. This results in outward deflection at regions 22 and 23. When the attractive forces are reduced, the elastic properties of body member 16 urge it to its original shape. Thus, upon selective actuation of the attractive forces, a movement is generated which will emit an acoustic signal when shell 10 is submerged in an appropriate liquid medium, such as seawater.

Figure 2:
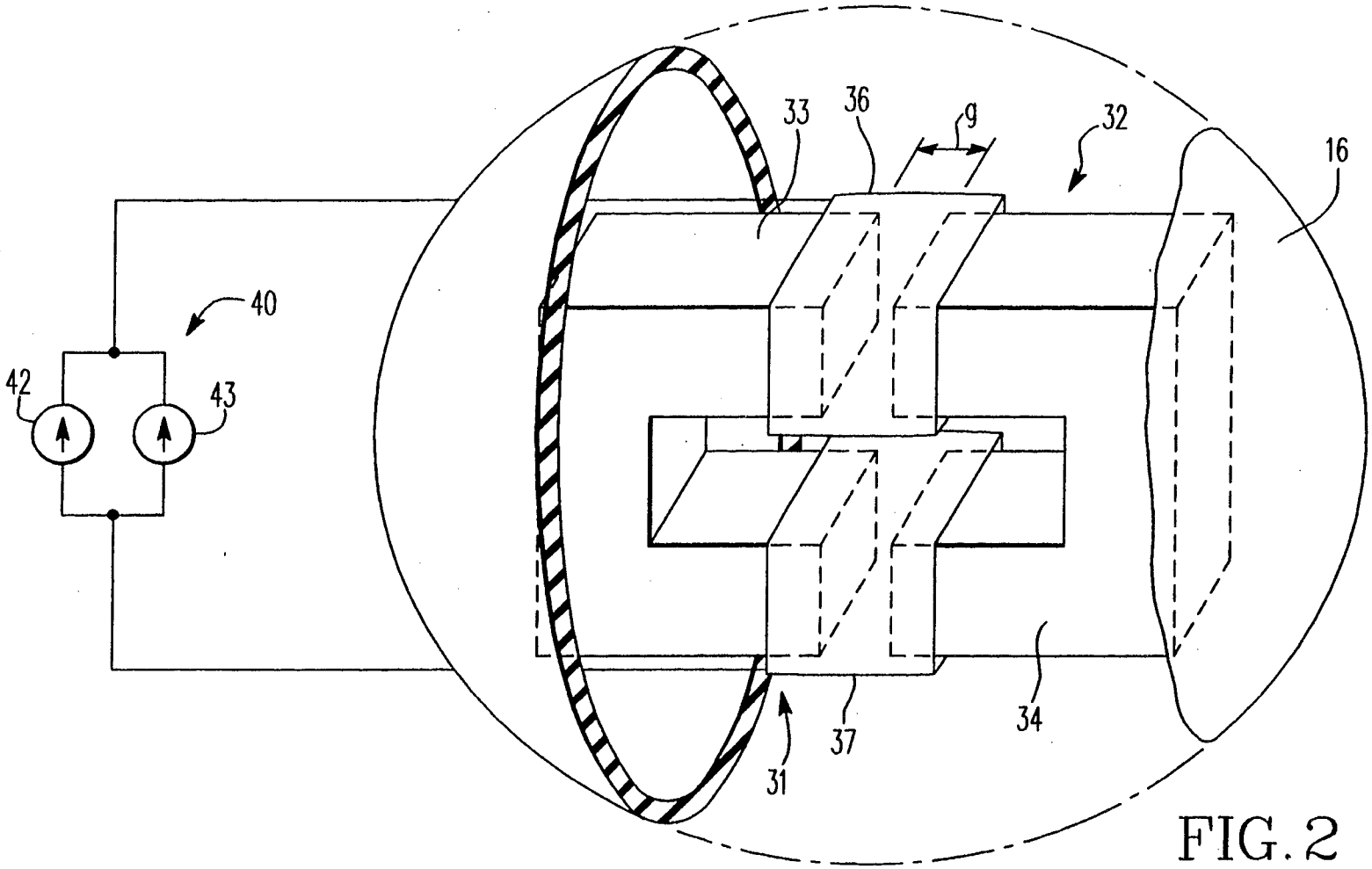
FIG. 2 is a diagrammatic representation of a sonar transmitter constructed in accordance with the invention illustrating, in perspective, a transducer projector having an outer shell thereof partially cut away to illustrate various internal components.

As shown in FIG. 2, the oppositely directed attractive forces may be created by a pair of substantially identical and opposed electromagnets 31 and 32. Electromagnets 31 and 32 are formed by cores, such as U-shaped cores 33 and 34, which are separated by a spatial gap "g". Gap "g" should be chosen so that it exceeds the expected range of motion of cores 33 and 34. Cores 33 and 34 are attached to the inner surface of body member 16. The above-referenced U.S. Pat. No. 5,126,979, at FIG. 4 thereof, illustrates a presently preferred means of attaching cores 33 and 34.

In order to produce magnetic flux in the cores, which in turn produces the magnetic attractive forces, cores 33 and 34 are circumscribed by coil assemblies, such as coil assemblies 36 and 37. Preferably, assemblies 36 and 37 are mounted to span gap "g" between opposing pole faces. This configuration permits the use of air gap seals and guides, if desired, as well as minimizing stray fields. Preferably, assemblies 36 and 37 are electrically connected in series. Equivalent parallel or independent windings, however, may be desirable in certain applications and/or implementations.

Source means, such as current source 40, provides the actuation signal to selectively drive electromagnets 31 and 32. In accordance with the teachings of the invention, the actuation signal is preferably the resultant signal of one or two driving signals of fundamental frequencies other than the fundamental frequency of the acoustic output signal. The driving signals are provided by one or both of respective driving signal sources 42 and 43. Preferably, the respective driving signals are sinusoidal signals or the effective equivalent and may have approximately equal amplitudes if desired. Instead of current sources, equivalent voltage sources may also be used in accordance with principles of source mutuality. The voltage sources would typically be serially-connected when two driving signals of different frequencies are desired.

Signal sources 42 and 43 may comprise any source capable of providing the respective driving signals. If the frequencies are low enough, switching power electronics may be used. Another possibility is low conduction angle drive. Also, two identical single-phase AC generators mechanically connected to run at slightly different speeds and driven by a single source could be used.

The intermediate transmission line between the source means and the transducer should be chosen to optimize performance depending upon the particular application. Simple coaxial cable is reasonably well-suited for this purpose. Also, intermediate magnetics such as transformers may be desirable in some applications.

Cores 33 and 34 should be constructed of a material having high magnetic permeability. A material called Microlams is known to minimize lamination and eddy losses in transformers and the like when a relatively high frequency current is present. Microlams is a material formed of ground pieces which are grain oriented and pressed into a composite. The composite nature of Microlams would permit rounded legs and a custom molded magnetic structure for minimum weight and convenient integral mounting. Thus, Microlams is thought to be well-suited in this application.

The structure of an electromagnetic sonar transducer designed for low frequency operation in combination with the liquid medium in which it will operate may, at best, have the characteristics of a low pass filter ("LPF"). A LPF transmits all frequencies below a characteristic high cutoff frequency, $\omega_{hc}$, with little attenuation. In an ideal LPF, all frequencies above $\omega_{hc}$ are completely blocked. Real LPFs, however, generally attenuate frequencies above $\omega_{hc}$ by an increasingly greater number of decibels as the frequency increases. Thus, in order for the acoustic signal to propagate with little attenuation, the magnetic attractive force must have a component below $\omega_{hc}$. Any undesirable frequencies must be far removed.

An electromagnetic sonar transmitter designed to operate at higher frequencies will typically be physically smaller than a low frequency transducer. In this case, the transducer may approximate the characteristics of a band pass filter ("BPF"), wherein frequencies below a low cutoff frequency $\omega_{lc}$ are also attenuated. This low cutoff is primarily due to mechanical resonance of the smaller transducer shell. Often, the transducer structure merely "peaks" near the upper cutoff frequency $\omega_{hc}$ thereby looking like a BPF at about this frequency. The liquid medium in which the transducer operates generally has the characteristics of a LPF.

These filtering characteristics of an electromagnetic transducer have presented problems in the past, as described below, in that the electromagnetic force is proportional to the square of the current in the coil assemblies 36 and 37. Specifically, the presence of bias magnetization has created harmonics which are within, or are very close to, the pass band of the transducer. Consider the following derivation which will be useful in explaining the present invention and is improvement over the prior art:

1. Provide the following total current:

$I(t)=I_o+i_1(t)+i_2(t)$ where:

$I_o$ is a direct current (for bias flux)

$i_1(t)=I_1 \cos \omega_1 t$ $i_2(t)=I_2 \cos \omega_2 t$

2. Since force is proportional to the square of the current, square I(t):

$$
\begin{aligned}
I^2(t) &= (I_o + i_1(t) + i_2(t))(I_o + i_1(t) + i_2(t)) \\
&= I_o(I_o + i_1(t) + i_2(t)) \\
&\quad + i_1(t)(I_o + i_1(t) + i_2(t)) \\
&\quad + i_2(t)(I_o + i_1(t) + i_2(t)) \\
&= I_o^2 + I_o i_1(t) + I_o i_2(t) + i_1^2(t) + i_1(t) i_2(t) \\
&\quad + I_o i_1(t) + I_o i_2(t) + i_2^2(t) + i_1(t) i_2(t) \\
&= I_o^2 + 2I_o i_1(t) + 2I_o i_2(t) + i_1^2(t) + i_2^2(t) \\
&\quad + 2i_1(t) i_2(t) \\
(1) \quad &= (I_o^2 + (I_1^2 + I_2^2)/2) \\
(2) \quad &+ I_1 I_2 \cos(\omega_1 - \omega_2)t \\
(3) \quad &+ I_o I_1 \cos \omega_1 t \\
(4) \quad &+ I_o I_2 \cos \omega_2 t \\
(5) \quad &+ I_1^2/2 \cos 2\omega_1 t \\
(6) \quad &+ I_2^2/2 \cos 2\omega_2 t \\
(7) \quad &+ I_1 I_2 \cos(\omega_1 + \omega_2)t
\end{aligned}
$$

This derivation shows that force components are produced at seven frequencies: DC, $\omega_1-\omega_2$, $\omega_1$, $\omega_2$, $2\omega_1$, $2\omega_2$, $\omega_1+\omega_2$. Prior art practice can be shown in the above analysis by setting $I_2$ equal to zero. When this is done, the following frequency components are present in the force: DC, $\omega_1$, $2\omega_1$. While a force component is produced at $\omega_1$, as desired, significant second harmonic distortion may also be introduced at $2\omega_1$:

$D_2=A_2/A_1=I_1^2/(2I_oI_1)=I_1/2I_o=\alpha/2$ where:

$\alpha=I_1/I_o$.

This harmonic distortion can have the effect of reducing the transducer's operating bandwidth, since it has been necessary to utilize only actuation frequencies such that the harmonic $2\omega_1$ is well above $\omega_{hc}$.

It can also be seen, however, that harmonic distortion is inversely proportional to the value of the DC bias current, $I_o$. Thus, designers have tended in the past to decrease this unwanted distortion by increasing the bias magnetization. This technique tends to reduce the operating depth of the transducer due to the inherent instability introduced as bias magnetization is increased. Additionally, if the bias magnetization is provided by increasing the bias current, $I_o$, the iron cross section of the cores must then be sufficient to accommodate the additional flux. The overall size of the transducer must therefore be increased to provide this extra bias magnetization (whether in the form of an expensive permanent magnet or the larger core and additional copper). In the past, therefore, design has been a choice of tradeoffs between several undesirable alternatives.

In accordance with the invention, the squaring phenomena of electromagnets, which has traditionally been considered undesirable, may be advantageously used to produce a high power transmitter generally having lower distortion and greater bandwidth than than those which have been utilized in the past. All of this may be accomplished utilizing a projector which is smaller and more efficient than those which have been utilized in the past. Instead of using an electrical driving signal at the desired frequency of the acoustic signal, the source means of the invention drives the transducer in the absence of bias magnetization at electrical frequencies offset from the desired frequency of the acoustic signal.

Three cases of the invention have been identified which are believed to have particular utility. These are: (1) two higher frequency driving signals producing a difference frequency acoustic signal; (2) two lower frequency driving signals producing a summation frequency acoustic signal; and (3) one lower frequency driving signal producing a frequency-doubled acoustic signal. The fact that these frequencies will be produced as described herein can be seen by setting various currents in the above derivation to zero. Specifically, cases 1 and 2 are shown by setting the bias current, $I_o$, equal to zero. As a result, force components will be produced at the following five frequencies: DC, $\omega_1-\omega_2$, $2\omega_1$, $2\omega_2$, $\omega_1+\omega_2$ Case 3 may be shown by setting both the bias current, $I_o$, and $I_2$ to zero, where it can be seen that the force components are only produced at the following two frequencies: DC, $2\omega_1$.

A simple spectral comparison of source force components of the prior art technique compared with the present invention is helpful in order to fully understand and appreciate the significance of the teachings herein. For convenience and comparison, assume that the frequencies of $I_1$ and $I_2$ are quite close. The results of such a comparison are given in the TABLE below in which the values shown are normalized with respect to the force amplitude of the acoustic signal frequency which has been identified by underscore.

TABLE

Spectral Comparison of Normalized Source Force Component Amplitudes

| Eq. No. (p. 13) | Amplitude | Freq. | Prior Art (Bias) A | Prior Art (Bias) B | Present Invention Case 1 | Present Invention Case 2 A | Present Invention Case 2 B | Present Invention Case 3 |
|---|---|---|---|---|---|---|---|---|
| (1) | $I_o^2 + (I_1^2 + I_2^2)/2$ | DC | 3/2 | 5.1 | 1 | 1 | 1 | 1 |
| (2) | $I_1I_2$ | $\omega_1 - \omega_2$ | 0 | 0 | $\underline{1}$ | — | 1 | 0 |
| (3) | $I_oI_1$ | $\omega_1$ | $\underline{1}$ | $\underline{1}$ | 0 | 0 | 0 | 0 |
| (4) | $I_oI_2$ | $\omega_2$ | 0 | 0 | 0 | 0 | 0 | 0 |
| (5) | $I_1^2/2$ | $2\omega_1$ | 1/2 | 0.1 | 0 | — | 1/2 | $\underline{1}$ |
| (6) | $I_2^2/2$ | $2\omega_2$ | 0 | 0 | 1/2 | — | 1/2 | 0 |
| (7) | $I_1I_2$ | $\omega_1 + \omega_2$ | 0 | 0 | 1/2 | $\underline{1}$ | $\underline{1}$ | 0 |

Assumptions:

Prior Art:

A. $I_o = 1$, $I_1 = 1$, $I_2 = 0$, $\alpha = 1$, $D_2 = 0.5$ (higher distortion)

B. $I_o = 5$, $I_1 = 1$, $I_2 = 0$, $\alpha = 0.2$, $D_2 = 0.1$ (lower distortion)

Present Invention:

Case 1: $I_o = 0$, $I_1 = 1$, $I_2 = 1$

Case 2: A. $\omega_1 = \omega_2$, $I_o = 0$, $I_1 = 1$, $I_2 = 1$

B. $\omega_1 > \omega_2$, $I_o = 0$, $I_1 = 1$, $I_2 = 1$

Case 3: $I_o = 0$, $I_1 = 1$, $I_2 = 0$

Case 1 may be used, for example, in applications in which it is desired that very low frequency acoustic signals be produced. It is often difficult or impractical in these situations to provide a driving source directly producing such low frequencies. However, an acoustic signal will propagate efficiently at the difference frequency, as long as the frequency difference between the driving signal at $\omega_2$ and the driving signal at $\omega_1$ is less than $\omega_{hc}$. The DC component will not propagate. Neither will the other three components, which are chosen to be well above $\omega_{hc}$. While lower frequencies may be used, it is generally desirable that frequencies $\omega_1$ and $\omega_2$ are at least one decade above $\omega_{hc}$. If so, even a modest LPF characteristic e.g., a single pole at 20 dB/decade, will give this result.

In case 2, it will generally be desired that both frequencies $\omega_1$ and $\omega_2$ be set to the same frequency (condition A) in order to minimize distortion. In condition A, the amplitude of the difference frequency, $\omega_1-\omega_2=0$, is added to the DC component. The components $2\omega_1$ and $2\omega_2$ are equal to $\omega_1+\omega_2$. As such, their amplitudes are added to the sum frequency. It may, in some application of case 2, be desirable for $\omega_1$ and $\omega_2$ to be of disparate frequencies (condition B). Despite the possible appearance of some subharmonic distortion in condition B, the invention nevertheless offers significant advantages over the prior art.

Case 3 ideally produces force components only at DC and $2\omega_1$. As can be seen, however, case 3 (at least in the ideal model) is completely devoid of harmonic distortion. This can be a very desirable consequence. A functionally equivalent arrangement wherein a low frequency driving signal at frequency $\omega_1$, is carried on a "high frequency carrier" at $\omega_2$ may, in certain applications and/or implementations, be advantageously used to reduce intermediate magnetics. In this case, the single output signal is at $2\omega_2$ (assuming $\omega_1>\omega_2$) with other force components ($2\omega_1$, $\omega_1+\omega_2$ and $\omega_1-\omega_2$) clustered together higher than (and easily filtered from) the acoustic signal at $2\omega_2$.

Figure 3:
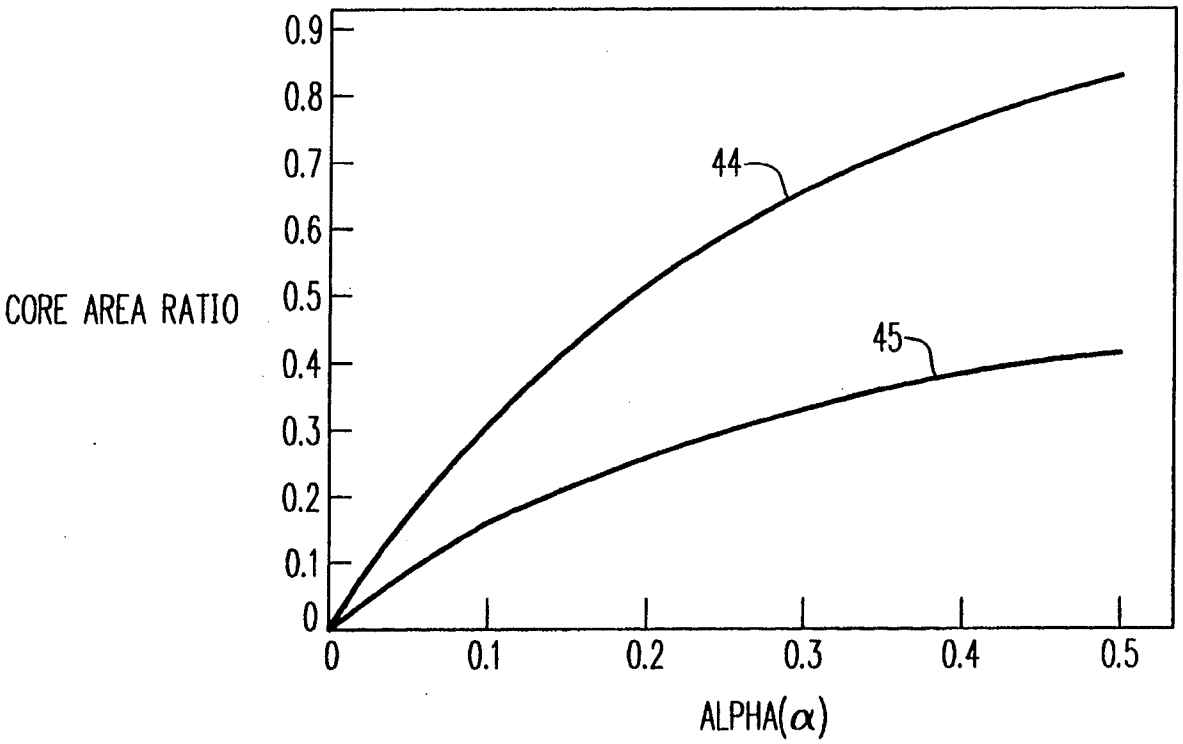
FIG. 3 is a graph illustrating ratio of cross sectional core area of the invention to cross-sectional core area of the prior art as plotted versus alpha (defined as twice the second harmonic distortion of prior art).

As described above, the elimination of bias magnets according to the invention also permits a reduction in the overall size of the transducer structure. To demonstrate this reduction, FIG. 3 present a comparison of the required cross sectional area of an electromagnet core driven according to the teachings of the present invention in relation to cross sectional core area if the transducer is driven according to the prior art (with bias supplied by DC current). In the prior art case in which bias is supplied by permanent magnets, which can also be eliminated according to this invention, the size advantage of this invention should be even more evident.

For this core comparison, the same desired output signal force amplitude and frequency (and coil and core geometry) are assumed. The core area is then altered to achieve the same maximum flux density in the magnetic circuit. The result is the ratio of the cross-sectional core area required by the present invention to that of the prior art. Because the prior art method also requires careful control of the amount of second harmonic distortion present in the source, the resultant figure of merit is shown as a function of $\alpha$. It may be helpful to note that $\alpha$, as defined above, is twice the second harmonic distortion and is equal to the ratio of source current amplitude to DC bias current. Plot 44 corresponds to the results if the transducer is driven as described for cases 1 or 2 above. Plot 45 corresponds to actuation according to case 3. As can be seen, the present invention yields increasingly better results than the prior art as the level of acceptable distortion in the prior art decreases.

Figure 4B:
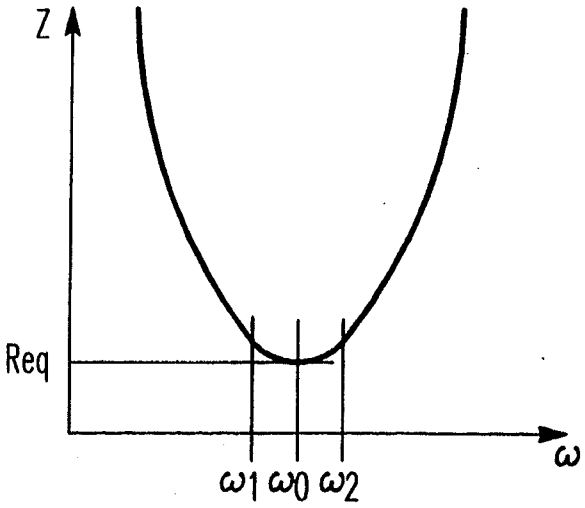
FIG. 4B is a curve illustrating impedance magnitude versus frequency characteristics of the circuit of FIG. 4A.
Figure 4A:
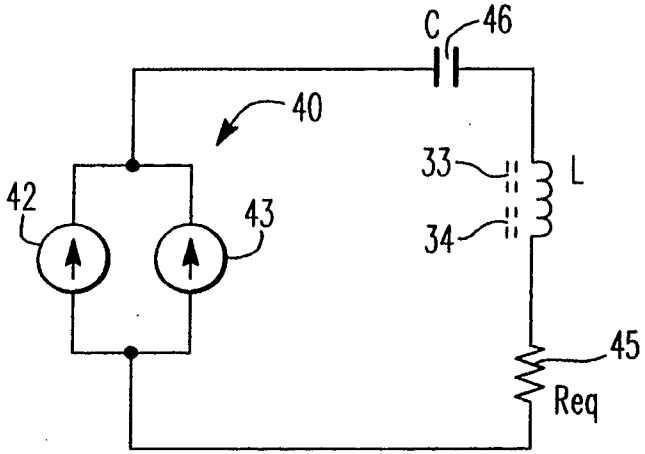
FIG. 4A is a schematic diagram of an equivalent electrical resonant circuit of the transmitter apparatus of the invention.

While the invention has been described generally in terms of current sources, duality principles will apply so that voltage sources may also be used. In order to reduce the required source voltage, it may be desirable to resonate the transmitter at a frequency $\omega_o$ intermediate to $\omega_1$ and $\omega_2$. As shown in FIGS. 4A and 4B, this will approximately reduce the impedance magnitude to the equivalent resistance, $R_{eq}$, of the overall circuit. $R_{eq}$ is represented schematically by resistor 45. When using current sources, resonance may be accomplished by a capacitor 46 of appropriate capacitance placed in series with coil assemblies 36 and 37. To contain high resonant voltages, capacitor 46 may be included within body member 16. Alternatively, when using a pair of voltage sources, parallel resonance may be desirable.

Capacitor 46 does impose a constraint on the overall bandwidth of the transducer. However, if $\omega_o$ is well above the operating frequency of the transducer and the quality factor "Q" of the resonant circuit is appropriately chosen, the resonant bandwidth can actually be made greater than that of the transducer structure. Also, the inductance of electromagnets 31 and 32 will vary somewhat with movement (i.e., changes in gap "g"). This would result in a variation of the voltage across the inductor driven by a constant frequency current source. If this were a problem due to a constraint in the maximum gap length, it can be minimized using a trap circuit or an external balancing inductance or capacitance.

Figure 5:
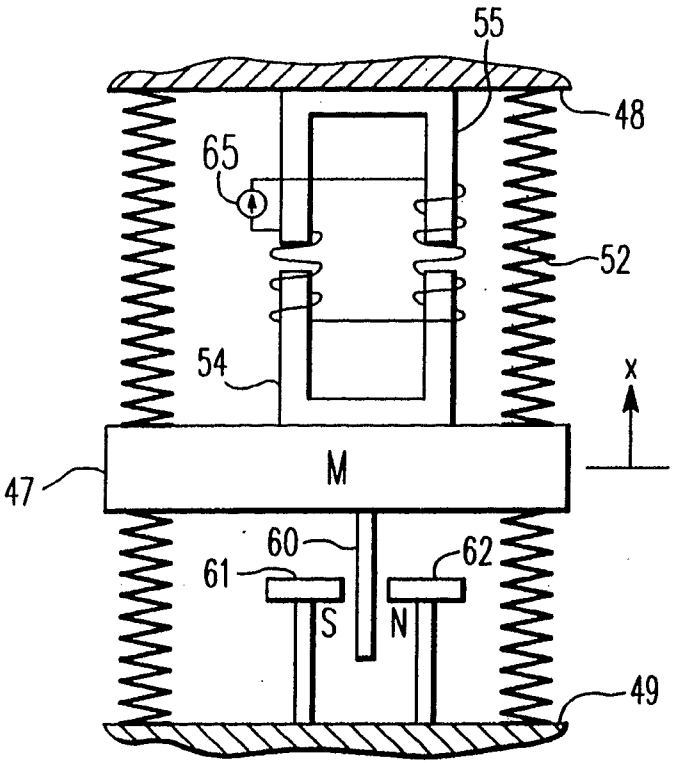
FIG. 5 is a diagrammatic view of an experimental model of a sonar transmitter apparatus which may be used to verify some of the teachings of the invention.

A relatively low cost and simple model for verifying many of the teachings of the invention is illustrated in FIG. 5. A moveable mass 47 represents the combination of the liquid medium and the flexible member. Mass 47 is supported between rigid bases 48 and 49 by supporting springs, such as spring 52. The supporting springs may be, for example, preloaded compression springs. The electromagnets are formed by a pair of C-cores 54 and 55. C-core 54 is fixedly attached to mass 47. Similarly, C-core 55 is attached to base 48. A dashpot, representing viscous losses of the mass in the transmissive liquid, may be formed by mounting a thin conductive plate 60 depending from mass 47 such that it interposes opposite magnetic poles 61 and 62.

Figure 6:
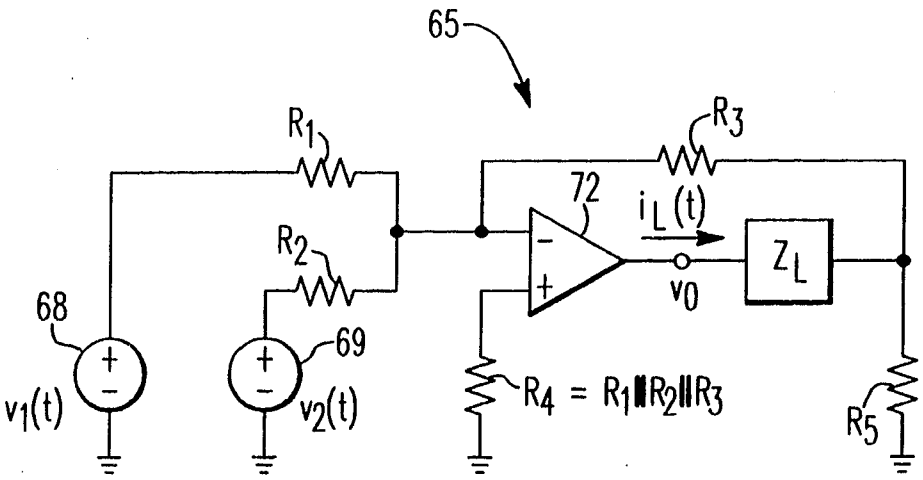
FIG. 6 is a schematic diagram of a low cost current source which may be used with the experimental model of FIG. 5.

A current source 65 actuates the electromagnets. FIG. 6 illustrates a suitable source wherein two standard laboratory signal generators 68 and 69 act as voltage sources to drive a summing network surrounding operational amplifier 72. Signal generators 68 and 69 produce respective driving signal voltages having the desired frequencies of the current sources. The network acts as a voltage-to-current converter which drives the electromagnets (represented by impedance $Z_L$) with current $i_L(t)$. An electromagnetic attraction force is thus produced, causing movement in the "x" direction as the actuation signal peaks. During troughs in the actuation signal, the springs urge mass 47 toward its original equilibrium at x=O. This movement may be observed visually. Alternatively, a simple digital simulation of the electrical analog of the system may be configured to easily solve for "x(t)".

It can thus be seen that an electromagnetic sonar transmitter has been provided without the need for bias magnetization. For an equivalent source level and radiating surface area, the invention further achieves a greater bandwidth and lower harmonic distortion than the prior art. Considerable weight and cost reduction are possible by not having to increase bias flux in order to reduce output distortion. Although certain preferred embodiments have been described and shown herein, it is to be understood that various other embodiments and modifications can be made within the scope of the following claims.

We claim:

1. A sonar transmitter apparatus for radiating an acoustic signal at a predetermined frequency into a liquid medium, said sonar transmitter apparatus comprising:

a movable member operable to emit said acoustic signal from a radiating surface thereof;

electromagnet means attached to said movable member and responsive to an electrical actuation signal for producing an electromagnetic attractive force having a component at said predetermined frequency to actuate said movable member; and source means for providing said electrical actuation signal, said actuation signal having a first driving signal and a second driving signal, said first and second driving signals having a frequency difference equal to said predetermined frequency.

2. The sonar transmitter apparatus of claim 1 wherein said movable member comprises an elliptical flexible body member having two mutually orthogonal axes and further wherein said electromagnet means comprises a pair of electromagnets attached to opposite portions of said body member along said one of said two mutually orthogonal axes.

3. The sonar transmitter apparatus of claim 2 wherein said electromagnets include a pair of coil assemblies for conducting said actuation signal.

4. The sonar transmitter apparatus of claim 3 wherein said coil assemblies are electrically connected in series.

5. The sonar transmitter apparatus of claim 3 wherein said coil assemblies are situated spanning a spatial gap between mutually opposing pole faces of said pair of electromagnets.

6. The sonar transmitter apparatus of claim 1 wherein said first and second driving signals are effectively sinusoidal signals.

7. The sonar transmitter apparatus of claim 6 wherein said first and second driving signals have substantially the same effective amplitude.

8. The sonar transmitter apparatus of claim 1 further comprising a capacitor electrically connected to said electromagnet means to produce a resonant circuit tuned to a resonant frequency between respective frequencies of said first driving signal and said second driving signal.

9. The sonar transmitter apparatus of claim 8 wherein said capacitor is electrically connected in series with said electromagnet means.

10. A method of radiating an acoustic signal from an electromagnetic acoustic projector into a liquid medium, said method comprising:

establishing a first driving signal;

establishing a second driving signal having a frequency difference with respect to said first driving signal, said frequency difference equal to a predetermined frequency of said acoustic signal;

superimposing said first and second driving signals to produce a resultant electrical actuation signal;

applying said resultant electrical actuation signal to at least one coil assembly of said electromagnetic acoustic projector being at least partially submerged in said liquid medium, thereby producing an electromagnetic force actuating said electromagnetic acoustic projector at said predetermined frequency to radiate said acoustic signal.

11. The method of claim 10 wherein said first and second driving signals are effectively sinusoidal signals.

12. The method of claim 10 wherein said first and second driving signals are essentially constant current signals.

13. The method of claim 10 wherein said first and second driving signals each have substantially the same effective amplitude.

14. A sonar transmitter apparatus for radiating an acoustic signal at a predetermined frequency into a liquid medium, said sonar transmitter apparatus comprising:

a movable member operable to emit said acoustic signal from a radiating surface thereof;

electromagnet means attached to said movable member and responsive to an electrical actuation signal for producing an electromagnetic attractive force having a component at said predetermined frequency to actuate said movable member; and source means for providing said electrical actuation signal, said actuation signal having a first driving signal and a second driving signal, a sum frequency of said first and second driving signals equal to said predetermined frequency.

15. The sonar transmitter apparatus of claim 14 wherein said movable member comprises an elliptical flexible body member having two mutually orthogonal axes and further wherein said electromagnet means comprises a pair of electromagnets attached to opposite portions of said body member along said one of said two mutually orthogonal axes.

16. The sonar transmitter apparatus of claim 15 wherein said electromagnets include a pair of coil assemblies for conducting said actuation signal.

17. The sonar transmitter apparatus of claim 16 wherein said coil assemblies are electrically connected in series.

18. The sonar transmitter apparatus of claim 16 wherein said coil assemblies are situated spanning a spatial gap between mutually opposing pole faces of said pair of electromagnets.

19. The sonar transmitter apparatus of claim 14 wherein said first and second driving signals are effectively sinusoidal signals.

20. The sonar transmitter apparatus of claim 19 wherein said first and second driving signals have substantially the same effective amplitude.

21. The sonar transmitter apparatus of claim 14 further comprising a capacitor electrically connected to said electromagnet means to produce a resonant circuit tuned to a resonant frequency between respective frequencies of said first driving signal and said second driving signal.

22. The sonar transmitter apparatus of claim 21 wherein said capacitor is electrically connected in series with said electromagnet means.

23. A method of radiating an acoustic signal at a predetermined frequency from an electromagnetic acoustic projector into a liquid medium, said method comprising:

establishing a first driving signal;

establishing a second driving signal;

said predetermined frequency of said acoustic signal equal to a sum frequency of said first and second driving signals;

superimposing said first and second driving signals to produce a resultant electrical actuation signal;

applying said resultant electrical actuation signal to at least one coil assembly of said electromagnetic acoustic projector being at least partially submerged in said liquid medium, thereby producing an electromagnetic force actuating said electromagnetic acoustic projector at said predetermined frequency to radiate said acoustic signal.

24. The method of claim 23 wherein said first and second driving signals are effectively sinusoidal signals.

25. The method of claim 23 wherein said first and second driving signals are essentially constant current signals.

26. The method of claim 23 wherein said first and second driving signals each have substantially the same effective amplitude.

27. A sonar transmitter apparatus for radiating an acoustic signal at a predetermined frequency into a liquid medium, said sonar transmitter apparatus comprising:

a movable member operable to emit said acoustic signal from a radiating surface thereof;

electromagnet means attached to said movable member and responsive to an electrical actuation signal for producing an electromagnetic attractive force having a component at said predetermined frequency to actuate said movable member; and source means for providing said electrical actuation signal, said electrical actuation signal having a frequency equal to one-half said predetermined frequency.

28. The sonar transmitter apparatus of claim 27 wherein said movable member comprises an elliptical flexible body member having two mutually orthogonal axes and further wherein said electromagnet means comprises a pair of electromagnets attached to opposite portions of said body member along said one of said two mutually orthogonal axes.

29. The sonar transmitter apparatus of claim 28 wherein said electromagnets include a pair of coil assemblies for conducting said actuation signal.

30. The sonar transmitter apparatus of claim 29 wherein said coil assemblies are electrically connected in series.

31. The sonar transmitter apparatus of claim 29 wherein said coil assemblies are situated spanning a spatial gap between mutually opposing pole faces of said pair of electromagnets.

32. A method of radiating an acoustic signal from an electromagnetic acoustic projector into a liquid medium, said method comprising:

establishing a driving signal having a frequency one-half a predetermined frequency of said acoustic signal; and applying said resultant electrical signal no at least one coil assembly of said electromagnetic acoustic projector being at least partially submerged in said liquid medium, thereby producing an electromagnetic force actuating said electromagnetic acoustic projector at said predetermined frequency to radiate said acoustic signal.

33. The method of claim 32 wherein said driving signal is an essentially constant current signal.

34. The method of claim 32 wherein said driving signal is carried on a high frequency carrier signal having a preselected carrier frequency.

* * * * *